US008098878B2

(12) United States Patent
Andersen

(10) Patent No.: US 8,098,878 B2
(45) Date of Patent: Jan. 17, 2012

(54) MINIATURE VOICE COIL WITH INTEGRATED COUPLING COIL

(75) Inventor: Morten Kjeldsen Andersen, Odder (DK)

(73) Assignee: Gettop Europe R&D ApS, Herlev (DK)

( * ) Notice: Subject to any disclaimer, the term of this patent is extended or adjusted under 35 U.S.C. 154(b) by 881 days.

(21) Appl. No.: 12/142,365

(22) Filed: Jun. 19, 2008

(65) Prior Publication Data

US 2009/0003645 A1 Jan. 1, 2009

Related U.S. Application Data

(60) Provisional application No. 60/936,341, filed on Jun. 20, 2007.

(51) Int. Cl.
*H04R 25/00* (2006.01)

(52) U.S. Cl. ..... 381/405; 381/396; 381/400

(58) Field of Classification Search ..... 381/396, 381/400, 405, 407–409, 412
See application file for complete search history.

(56) References Cited

U.S. PATENT DOCUMENTS

2004/0197003 A1 10/2004 Ishigaki et al. ..... 381/400
2005/0244022 A1 11/2005 Muthuswamy et al. ..... 381/315

FOREIGN PATENT DOCUMENTS

EP 0 565 181 A1 4/1993
EP 1 128 705 A2 8/2001
EP 1 553 802 A2 7/2005
WO WO 03/063545 A1 7/2003

OTHER PUBLICATIONS

Standard Search Report dated Jan. 28, 2008 (1 page).
European Search Report for Application No. EP 08 15 7343 dated Oct. 27, 2009 (1 page).

*Primary Examiner* — Suhan Ni
(74) *Attorney, Agent, or Firm* — Nixon Peabody LLP

(57) ABSTRACT

The present invention relates to a miniature electro-acoustic transducer comprising a voice coil comprising an air gap voice coil portion at least partly positioned in an air gap of a magnet assembly, and a second voice coil portion attached to a diaphragm of the miniature transducer. The thickness of the second voice coil portion is 2-5 times larger than the thickness of the first voice coil portion. Moreover, the present invention relates to a voice coil for use in a miniature electro-acoustic transducer.

20 Claims, 5 Drawing Sheets

MINIATURE VOICE COIL WITH INTEGRATED COUPLING COIL

CROSS REFERENCE TO RELATED APPLICATION

This application claims the benefit of U.S. Provisional Application No. 60/936,341, filed Jun. 20, 2007, entitled "Miniature Voice Coil With Integrated Coupling Coil", which is hereby incorporated by reference in its entirety.

FIELD OF THE INVENTION

The present invention relates to a miniature voice coil with an integrated coupling coil for electro-magnetic coupling to a T-coil of an associated hearing aid. The present invention further relates to a miniature electro-acoustic transducer applying such miniature voice coil.

BACKGROUND OF THE INVENTION

Various solutions for providing an efficient electro-magnetic coupling between miniature transducers of cellular phones and T-coils of associated hearing aids have been suggested in the patent literature. An example of such a solution is given in US 2005/0244022.

US 2005/0244022 discloses a removable bezel for use with for example a cellular phone to enhance operation with a hearing aid. The removable bezel has an integrated electro-magnetic coil that is coupled to an audio output device of the cellular phone. The electro-magnetic coil is either inductively coupled to an acoustic transducer within the cellular phone or coupled thereto directly by direct electrical connections.

The electro-magnetic coil suggested in US 2005/0244022 constitutes an integrated part of a removable bezel and provides an enhanced magnetic field to a T-coil magnetic pick up within most conventional hearing aids.

It is a disadvantage of the arrangement suggested in US 2005/0244022 that the acoustic transducer of the cellular phone and the coil integrated in the bezel of the cellular phone are separate and discrete components. In case of a cellular phone not having an electro-magnetic coil integrated in its bezel, the bezel needs to be replaced before effective electro-magnetic coupling to a T-coil of an associated hearing aid can be achieved.

EP 1 128 705 relates to a voice coil having a flange portion protruding inward in the radial direction at an upper end portion of the voice coil whereby the voice coil takes a L-shaped cross-sectional shape. The upper end portion of the voice coil, i.e. the flange portion of the voice coil, is bonded and fixed to a central flat portion of a loudspeaker diaphragm. The increased bonding area obtained between the voice coil and the diaphragm prevents separation of the voice coil and the diaphragm.

The flange portion of the voice coil suggested in EP 1 128 705 aims purely at increasing the bonding area between the voice coil and the diaphragm. There is in EP 1 128 705 no mentioning of the dimensions of the voice coil, including its flange portion. Thus, neither the absolute nor the relative dimensions are derivable from the disclosure in EP 1 128 705. The flange portion is furthermore inwardly oriented in the radial direction and will therefore not contribute in any significant degree to increase the field strength of a radiated magnetic field so as to improve the electro-magnetic coupling to an external T-coil of an associated hearing aid.

It is an object of the present invention to provide a miniature electro-acoustic transducer offering enhanced electro-magnetic coupling to a T-coil of an associated hearing aid.

It is a further object of the present invention to provide a miniature voice coil for miniature electro-acoustic transducers, said voice coil being optimised for enhanced electro-magnetic coupling to a T-coil of an associated hearing aid.

SUMMARY OF THE INVENTION

The above-mentioned objects are complied with by providing, in a first aspect, a miniature electro-acoustic transducer comprising a voice coil attached to a diaphragm, and a magnet assembly comprising an air gap. The voice coil comprises a first voice coil portion and a second voice coil portion. The first voice coil portion is at least partly positioned in the air gap of the magnet assembly. The first voice coil portion has its primary extension in a direction substantially parallel to a direction of movement of the diaphragm of the miniature transducer. The second voice coil portion is attached to the diaphragm of the miniature transducer. The second voice coil portion is positioned outside of the air gap of the magnet assembly of the miniature transducer. The second voice coil portion, in a direction substantially perpendicular to the primary extension direction of the first voice coil portion, has a thickness being 2-5 times larger than a thickness of the first voice coil portion.

Thus, according to the present invention a miniature electro-acoustic transducer comprising a voice coil comprises an air gap portion (first voice coil portion) and a radiation portion (second voice coil portion) is provided. The term "radiation portion" is to be understood herein as a voice coil portion enhancing a strength of a radiated magnetic field of the voice coil so as to improve the electro-magnetic coupling to a T-coil of an associated hearing aid.

It is a characteristic feature of the voice coil that the before-mentioned first and second voice coil portions have different widths in that the width of the second voice coil portion exceeds the width of the first voice coil portion by 2 to 5 times. The significantly wider second voice coil portion provides, for a voice coil having a rectangular shape, increased mechanical stability to the piston of the diaphragm to which the voice coil is attached. The increased mechanical stability of the piston improves the frequency response of the miniature electro-acoustic transducer so that it may be applied as a so-called wideband transducer operating in a frequency range from around 300 Hz to around 7 kHz. For comparison, the frequency range of traditional miniature electro-acoustic transducers are normally limited to around 3.5 kHz.

The thicknesses of the first and second voice coil portions may be measured in various ways depending on the actual shape of the voice coil portions. In case the first and/or second voice coil portions have varying thicknesses, these thicknesses may be measured as average thicknesses of the first and second voice coil portions. Alternatively, the thicknesses may be measured as maximum or minimum thicknesses of the first and second voice coil portions.

The first voice coil portion may have a thickness to fit or match into the air gap of the magnet assembly. A typical thickness of the first voice coil portion may be in the range 0.2-0.3 mm. The second voice coil portion, which is positioned outside the air gap of the magnet assembly, has a significantly higher thickness. In fact the thickness of the second voice coil portion may be up to a 1.5 mm. Thus, the thickness of the second voice coil portion may exceed the width of the air gap—the latter typically having a width in the range 0.5-0.8 mm.

The first voice coil portion may comprise a wound Copper-Clad Aluminium (CCA) wire. Similarly, the second voice coil portion may comprise a wound CCA wire. The first and second voice coil portions may be manufactured separately. After manufacturing, the first and second voice coil portions may be attached to each other to form the final voice coil. In terms of electrical connection, the first and second voice coil portions may be connected in series or in parallel.

Alternatively, the first and second voice coil portions may comprise a single CCA wire. Thus, the first and second voice coil portions may be integrated into a single voice coil using appropriate winding techniques.

The shape of the voice coil according to the present invention may in principle be arbitrary. Thus, the first voice coil portion may, in a plane substantially perpendicular to the direction of movement of the diaphragm, have a substantially circular shape. In case of such a substantially circular shape, the first voice coil portion may encircle an inner voice coil region. In one embodiment of the present invention the second voice coil portion may extend into the inner voice coil region thereby forming an L-shaped cross-sectional profile of the voice coil. The inner voice coil region may have a diameter in the range 2-4 mm, such as a diameter of approximately 3 mm.

Similarly, the first voice coil portion may define an outer voice coil region into which the second voice coil portion may extend. Thus, in case the second voice coil portion extends into the inner voice coil region or the outer voice coil region the voice coil forms a L-shaped cross-sectional profile. In case the second voice coil portion extends into both the inner voice coil region and the outer voice coil region, the voice coil forms a T-shaped cross-sectional profile.

As an alternative to the substantially circular shape, the first voice coil portion may, in a plane substantially perpendicular to the direction of movement of the diaphragm, have a substantially rectangular shape. Such a rectangularly-shaped voice coil may comprise four straight voice coil segments interconnected by four curved corner segments.

In a preferred embodiment, the first voice coil portion has, in a plane substantially perpendicular to the direction of movement of the diaphragm, a substantially rectangular shape. In this preferred embodiment, the second voice coil portion extends into the outer voice coil region the voice coil thereby forming a L-shaped cross-sectional profile.

The magnet assembly may comprise an inner permanent magnet and an annular permanent magnet substantially concentrically arranged on a magnetically permeable yoke. The magnet assembly may further comprise an inner pole piece and an annular pole piece arranged on the inner permanent magnet and the annular permanent magnet, respectively. The annular pole piece may optionally be an integral part of the housing of the miniature electro-acoustic transducer.

The air gap of the magnet assembly may have a width in the range 0.5-0.8 mm, such as around 0.6 mm. The average magnetic flux density in the air gap may be in the range 0.3-1.5 T, such as in the range 0.5-1 T. The inner permanent magnet and/or the annular permanent magnets may comprise NdFeB compounds having a remanence flux density of at least 1.2 T, a coercive force of at least 1000 kA/m and an energy product of at least 300 kJ/$m^3$. As an example, an NdFeB N44H magnet may be applied. However, other types of magnets are also applicable. Suitable pole piece materials are low carbon content steel/iron materials, such as materials similar to Werkstoff-No. 1.0330 (St 2), 1.0333 (St 3), 1.0338 (St 4), all in accordance to DIN EN 10130.

In a second aspect, the present invention relates to a miniature voice coil adapted to be attached to a diaphragm of a miniature electro-acoustic transducer. The voice coil comprises a first voice coil portion and a second voice coil portion. The first voice coil portion is adapted to be positioned in an air gap of a magnet assembly of the miniature transducer. The first voice coil portion has its primary extension in a direction substantially parallel to a direction of movement of the diaphragm of the miniature transducer. The second voice coil portion is adapted to be attached to the diaphragm of the miniature transducer and also adapted to be positioned outside of the air gap of the magnet assembly of the miniature transducer. The second voice coil portion, in a direction perpendicular to the primary extension direction of the first voice coil portion, has a thickness being 2-5 times larger than a thickness of the first voice coil portion.

Thus, according to the second aspect of the present invention a voice coil comprising an air gap portion (first voice coil portion) and a radiation portion (second voice coil portion) is provided. The term "radiation portion" is to be understood herein as a voice coil portion enhancing a strength of a radiated magnetic field of the voice coil so as to improve the electro-magnetic coupling to a T-coil of an associated hearing aid.

It is a characteristic feature of the voice coil that the beforementioned first and second voice coil portions have different widths in that the width of the second voice coil portion exceeds the width of the first voice coil portion by 2 to 5 times.

The first voice coil portion may have a thickness to fit or match into the air gap of the magnet assembly. A typical thickness of the first voice coil portion may be in the range 0.2-0.3 mm. The second voice coil portion, which is positioned outside the air gap of the magnet assembly, has a significantly higher thickness. In fact, the thickness of the second voice coil portion may be up to around 1.5 mm. Thus, the thickness of the second voice coil portion may exceed the width of the air gap—the latter typically having a width in the range 0.5-0.8 mm.

The first voice coil portion may comprise a wound CCA wire. Similarly, the second voice coil portion may comprise a wound CCA wire. The first and second voice coil portions may be manufactured separately. After manufacturing, the first and second voice coil portions may be attached to each other to form the final voice coil. In terms of electrical connection, the first and second voice coil portions may be connected in series or in parallel.

Alternatively, the first and second voice coil portions may comprise a single CCA wire. Thus, the first and second voice coil portions may be integrated into a single voice coil using appropriate wounding techniques.

Similar to the first aspect of the present invention, the shape of the voice coil according to the present invention may in principle be arbitrary. Thus, the first voice coil portion may, in a plane substantially perpendicular to the direction of movement of the diaphragm, have a substantially circular shape. In case of such a substantially circular shape, the first voice coil portion may encircle an inner voice coil region. In one embodiment of the present invention, the second voice coil portion may extend into the inner voice coil region thereby forming an L-shaped cross-sectional profile of the voice coil. The inner voice coil region may have a diameter in the range 2-4 mm, such as a diameter of approximately 3 mm.

Similarly, the first voice coil portion may define an outer voice coil region into which the second voice coil portion may extend. Thus, in case the second voice coil portion extends into the inner voice coil region or the outer voice coil region, the voice coil forms a L-shaped cross-sectional profile. In case the second voice coil portion extends into both the inner voice coil region and the outer voice coil region, the voice coil forms a T-shaped cross-sectional profile.

As an alternative to the substantially circular shape, the first voice coil portion may, in a plane substantially perpendicular to the direction of movement of the diaphragm, have a substantially rectangular shape. Such a rectangular shaped voice coil may comprise four straight voice coil segments interconnected by four curved corner segments.

In a preferred embodiment, the first voice coil portion has, in a plane substantially perpendicular to the direction of movement of the diaphragm, a substantially rectangular shape. In this preferred embodiment, the second voice coil portion extends into the outer voice coil region the voice coil thereby forming a L-shaped cross-sectional profile.

The number of windings forming the first voice coil portion may equal the number windings forming the second voice coil portion.

BRIEF DESCRIPTION OF THE DRAWINGS

The present invention will now be explained in further details with reference to the accompanying figures, where.

Figure 1A:
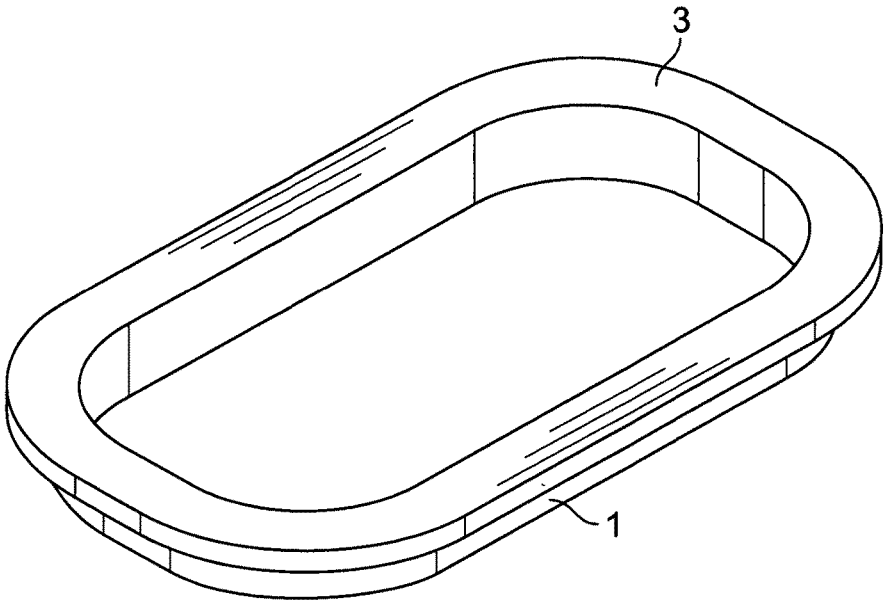
FIGS. 1*a* and 1*b* show a voice coil according to a preferred embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect, the present invention relates to a miniature voice coil adapted to be attached to displaceable diaphragms of miniature transducers. The voice coil according to the present invention comprises a first portion adapted to be positioned at least partly in an air gap of a magnet assembly of the miniature transducer, and a second portion adapted to enhance electro-magnetic coupling to a T-coil of an associated hearing aid.

As it will become clear from the detailed description below, the shape of the miniature voice coil according to the present invention will mechanically stabilize the piston portion of the diaphragm to which the miniature voice coil is attached. Thus, by applying the miniature voice coil according to the present invention, the piston portion of the diaphragm to which the voice coil is attached can be a relatively simple mechanical construction. For example, a rather complicated dome or spherically shaped piston portion can be avoided.

The voice coil according to the present invention may comprise two separate, interconnected coils, or it may be manufactured as one single integrated voice coil comprising both voice coil portions.

It is a characteristic feature of the voice coil according to the present invention that it, in a direction of movement of the diaphragm to which it is adapted to be attached, has a non-uniform width. More specific, it is a characteristic feature of the voice coil, according to the present invention, that the width of the voice coil portion adapted to abut the diaphragm exceeds the width of the voice coil portion to be positioned in the air gap. By implementing the voice coil according to the present invention, a safe attachment to the diaphragm is secured, and an effective electro-magnetic coupling to a T-coil of an associated hearing aid is provided.

Figure 1B:
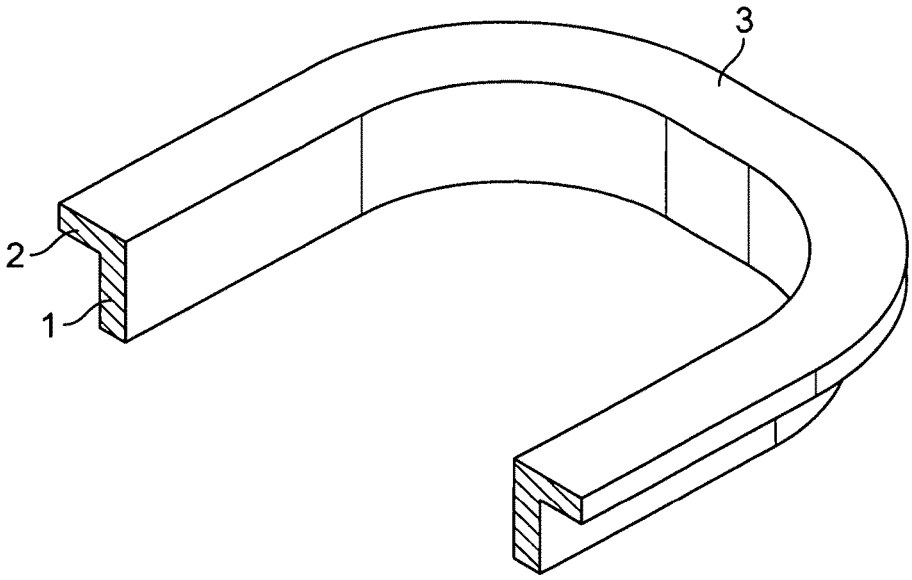

Referring now to FIG. 1, a preferred embodiment of the present invention is depicted in that FIGS. 1*a* and 1*b* show three-dimensional perspectives of a nearly rectangularly-shaped voice coil. The first portion 1 of the voice coil is adapted to be positioned in the air gap of the magnet assembly whereas the second portion 2 of the voice coil, and in particular the upper surface 3, is adapted to be attached to the diaphragm (not shown). The width of the second portion 2 of the voice coil is between 2 and 5 times the width of the first portion 1 of the voice coil.

The impedance of the voice coil may be around 32Ω. Preferably, the voice coil is made of a wound copper wire or a wound CCA wire. In the case of a CCA wire, the copper content may be around 15%. By using CCA, the mass of the voice coil can be kept at a reasonable low level whereby the acoustical sensitivity and the magnetic coupling to the magnet assembly can be kept at a maximum level. This is contrary to conventional voice coils in which voice coil designers are only allowed to seek maximum performance for one of these parameters. The CCA applied to wound the voice coil according to the present invention has a thinner isolating layer compared to conventional CCA wire. The thinner isolating layer reduces the overall wire thickness around 10-15% compared to standard CCA wire. By applying a CCA wire having a thinner isolating layer, the voice coil according to the present invention can be wound with a higher fill-factor yielding optimal performance in terms of acoustical sensitivity and magnetic radiation resulting in effective electro-magnetic coupling to a T-coil of an associated hearing aid.

When positioned in a miniature transducer, the second voice coil portion 2 is essentially free to emit electro-magnetic radiation so as to ensure an effective electro-magnetic coupling to a T-coil of an associated hearing aid. Preferably, and as depicted in FIGS. 1*a* and 1*b*, the second voice coil portion 2 extends in the outward direction of the voice coil. It has been determined that a second voice coil portion extending in the outward direction increases the magnetic field radiation. Thus, an outwardly directed second voice coil portion improves the electro-magnetic coupling to external T-coils compared to inwardly directed second voice coil portions. This will be discussed in further details in connection with FIGS. 5 and 6.

The first and second voice coil portions are connected in series. This may be achieved by providing two separate voice coils and connecting said two voice coils in series. Preferably, the first and second voice coil portions are integrated in one single voice coil having a cross-sectional shape as depicted in FIG. 1*b*.

A typical thickness of the first voice coil portion for miniature loudspeakers targeted for portable terminal applications may be in the range 0.2-0.3 mm. The second voice coil portion, which is positioned outside the air gap of the magnet assembly and is adapted to be attached to the diaphragm, has a significantly higher thickness. In fact, the thickness of the second voice coil portion may be up to around 1.5 mm.

Figure 2A:
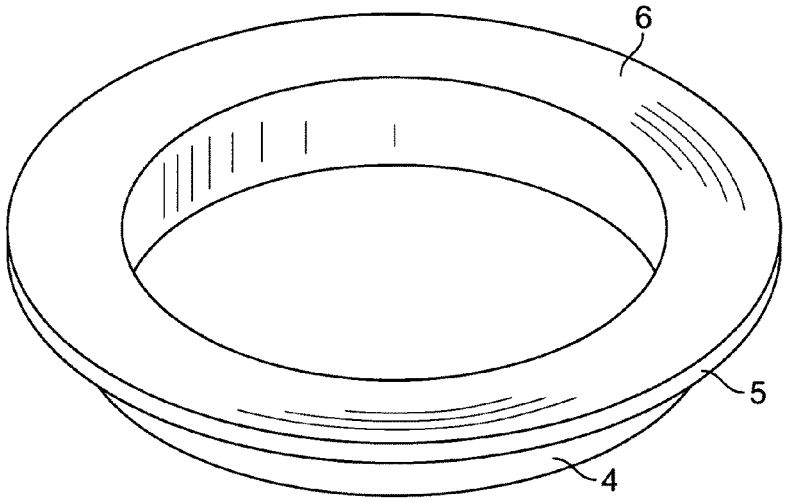
FIGS. 2*a* and 2*b* shows a voice coil according to another embodiment of the present invention.
Figure 2B:
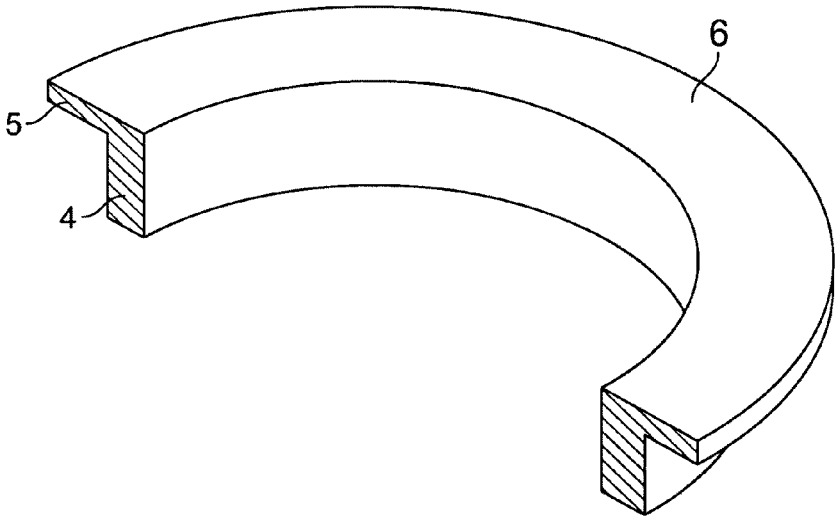

Referring now to FIGS. 2*a* and 2*b*, a voice coil according to another embodiment of the present invention is depicted. The first portion 4 of the voice coil takes a substantially cylindrical shape whereas the portion of the voice coil 5, which is to be attached to the diaphragm, takes a substantially disc shape with an opening in the middle. The overall outer diameter of the voice coil depicted in FIG. 2 is typically around 4 mm whereas the total height of the voice coil is less than 1 mm. The thickness of the first voice coil portion may be in the range 0.2-0.3 mm, whereas the thickness of the second voice coil portion may be up to around 1.5 mm.

Two free wire ends (not shown) allow electrical access to the voice coil. The voice coils of FIGS. 1 and 2 are integrated voice coils in that the first and second voice coil portions are integrated in the same voice coil using an appropriate wounding process. Such appropriate wounding process may involve a mould being formed by three rotating winding tool parts.

It should be noted that the voice coils depicted in FIGS. 1 and 2 may, in addition to the outwardly oriented second portions, also comprise inwardly oriented portions of variable dimensions. Such inwardly oriented portions will, in combination with the outwardly oriented second portions, provide a T-shaped cross-sectional profile of the voice coil.

Figure 3:
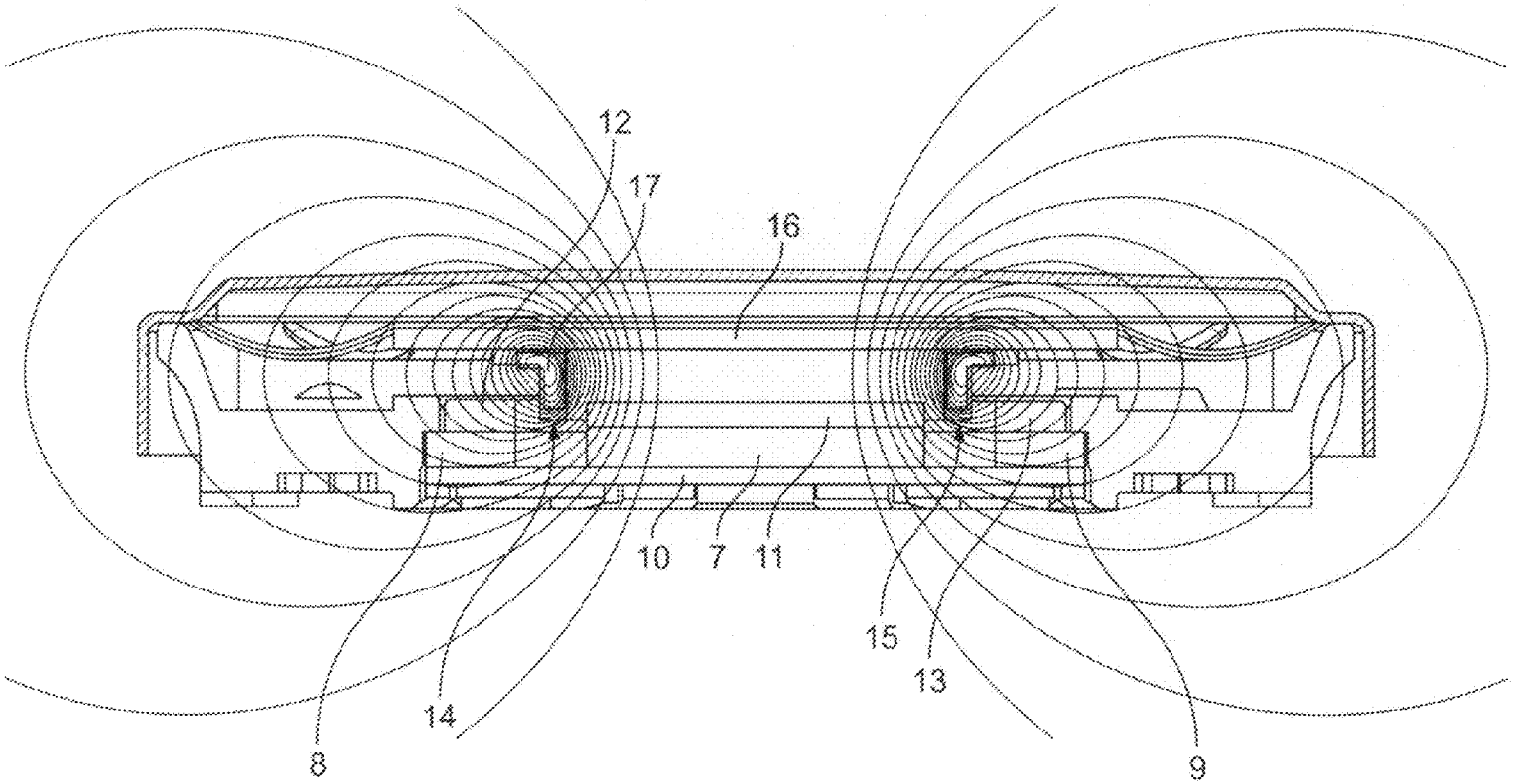
FIG. 3 shows a miniature transducer according to the present invention.

Referring now to FIG. 3, a cross-sectional view of a miniature electro-acoustical transducer applying a voice coil 17 according to the present invention is depicted. As depicted in FIG. 3, the miniature transducer comprises a magnet assembly comprising an inner permanent magnet 7, outer permanent magnets 8, 9 and a magnetically permeable yoke 10 on which the inner and outer magnets are arranged. An inner pole piece 11 is arranged on the inner permanent magnet 7. Similarly, outer pole pieces 12, 13 are arranged on outer permanent magnets 8, 9, respectively. Optionally, the outer pole pieces 12, 13 may form an integral part of a transducer housing. Air gaps 14, 15 are provided between the inner pole piece 11 and outer pole pieces 12, 13.

Each of the air gaps may have a width in the range 0.5-0.8 mm, such as around 0.6 mm. The average magnetic flux density in the air gap may be in the range 0.3-1.5 T, such as in the range 0.5-1 T.

The inner permanent magnet and/or the outer permanent magnets may comprise NdFeB compounds having a remanence flux density of at least 1.2 T, a coercive force of at least 1000 kA/m and an energy product of at least 300 kJ/m$^3$. As an example, an NdFeB N44H magnet may be applied. However, other types of magnets are also applicable.

Suitable pole piece materials are low carbon content steel/iron materials, such as materials similar to Werkstoff-No. 1.0330 (St 2), 1.0333 (St 3), 1.0338 (St 4), all in accordance to DIN EN 10130.

As previously mentioned the voice coil is constituted by two parts or portions. A first portion of the voice coil is positioned in the air gap of the magnet assembly. Upon applying electric drive signals to the voice coil via an external connection terminal, the diaphragm 16 shown in FIG. 3 is displaced in accordance with the electric drive signal. Preferably, the diaphragm comprises a diaphragm assembly, such as a laminated diaphragm structure. Thus, the first portion of the voice coil, which is at least partly positioned in the air gap of the magnet assembly, provides the required force to the diaphragm in order to generate audible sound. A second part of the voice coil is attached to the diaphragm 12. In addition, the second portion is fixedly attached to or integrated with the first portion of the voice coil. Thus, due to the mutually fixed relationship between the first and second voice coil portions secures that forces acting on the first portion of the voice coil, due to electric drive signals provided thereto, is effectively transferred to the diaphragm 12.

The voice coil 17 shown in FIG. 3 is fabricated as described in connection with FIGS. 1 and 2.

FIG. 3 also depicts the external magnetic flux lines 13 generated by the voice coil according to the present invention. As seen, the magnetic flux lines spreads out of the housing of the miniature electro-acoustic transducer. The fact that magnetic flux lines are present in a significant amount outside the housing of electro-acoustic transducer facilitates that an effective electro-magnetic coupling to a T-coil of an associated hearing aid is provided by the miniature electro-acoustic transducer shown in FIG. 3. A more detailed discussion of this will be given in connection with FIGS. 5 and 6.

Figure 4:
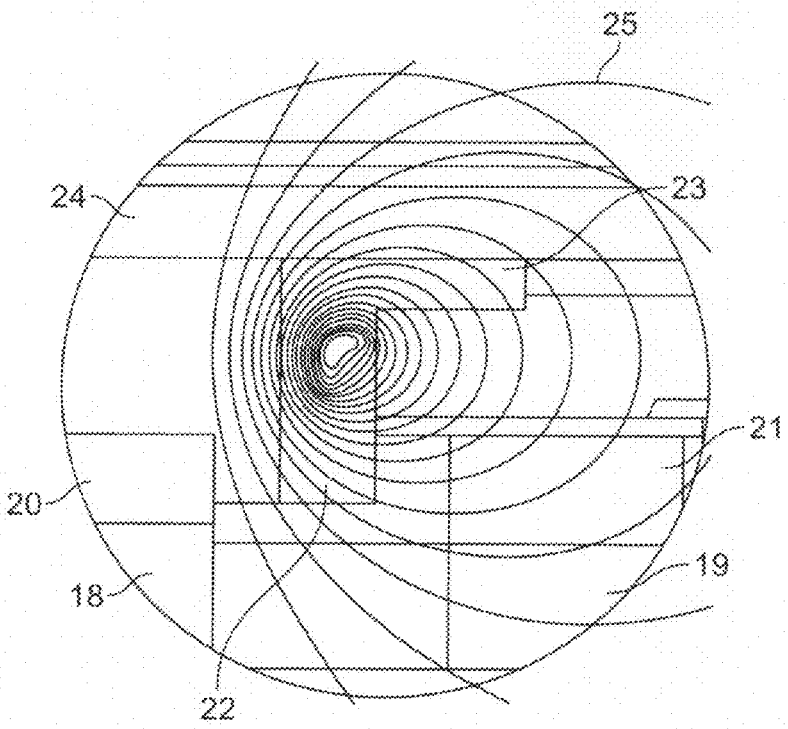
FIG. 4 shows a close-up illustration of a cross-sectional view of a voice coil according to the present invention.

FIG. 4 shows a cross-up of the right part of the voice coil of FIG. 3. As depicted in FIG. 4, the inner permanent magnet 18 and the outer permanent magnet 19 are also shown. The inner pole piece 20 is arranged on the inner permanent magnet 18, and the outer pole piece 21 is arranged on the outer permanent magnet 19. The voice coil itself comprises an air gap or first portion 22 and a diaphragm or second portion 23 secured to the diaphragm 24. As previously mentioned, the width of the diaphragm portion 23 exceeds the width of the air gap portion by 2-5 times. The voice coil shown in FIG. 4 is fabricated as described in connection with FIGS. 1 and 2.

FIG. 4 depicts the external flux lines 25 generated by the voice coil. As seen, the flux lines spreads out of the housing of the miniature electro-acoustic transducer.

Figure 5:
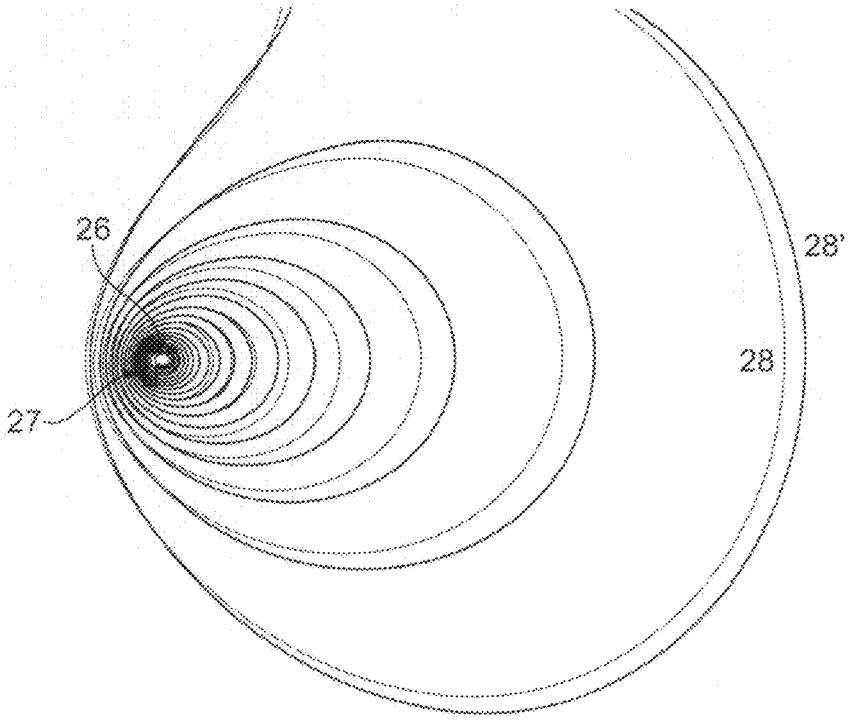
FIG. 5 shows a comparison of flux lines originating from an inwardly directed flange and an outwardly directed flange.

FIG. 5 shows a direct comparison of flux lines generated by voice coils having inwardly and outwardly oriented flanges. In FIG. 5 the contour of the voice coil 26 having an outwardly oriented flange is black, whereas the contour of the voice coil 27 having an inwardly oriented flange is white. As seen from FIG. 5 the flux lines are present in pairs 28, 28'. For each pair of flux lines the outermost flux line 28' originates from the voice coil having the outwardly oriented flange. It is clear from FIG. 5 that flux lines originating from outwardly oriented voice coil flanges extend over longer distances compared to flux lines generated by inwardly oriented voice coil flanges. This is also demonstrated in FIG. 6 which shows simulated flux densities for various types of voice coil shapes. As shown in the right part of FIG. 6 flux densities from voice coils having no flanges, a thick inner flange, a thin outer flange and a thick outer flange have been calculated. The flux densities have been calculated along a virtual line positioned at a distance of 10 mm from the voice coil. Confer with the inserted illustration in FIG. 6.

Figure 6:
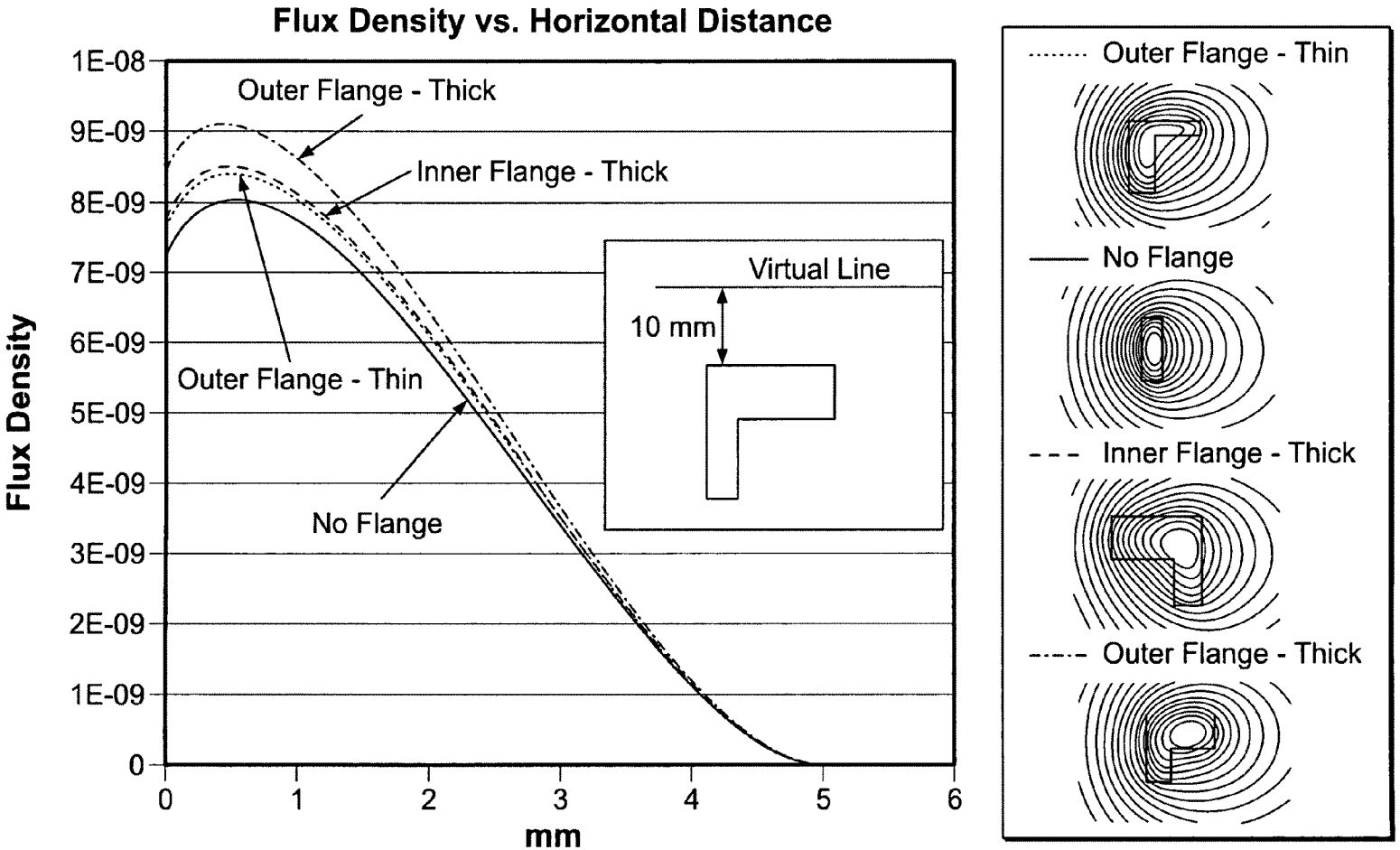
FIG. 6 shows simulations of flux lines from various shapes of voice coils.

As shown in FIG. 6, the voice coil having the thick outer flange produces the highest flux density, whereas the voice coil having no flange produces the lowest flux density. Voice coils having a thin outer flange or a thick inner flange produces similar flux densities. FIG. 6 also demonstrates that a voice coil having an outer flange produces a higher flux density than a voice coil having an inner flange of similar dimensions.

The invention claimed is:

1. A miniature electro-acoustic transducer comprising a voice coil attached to a diaphragm, and a magnet assembly comprising an air gap, said voice coil comprising:

a first voice coil portion at least partly positioned in the air gap of the magnet assembly, said first voice coil portion having its primary extension in a direction substantially parallel to a direction of movement of the diaphragm of the miniature transducer;

a second voice coil portion attached to the diaphragm of the miniature transducer, said second voice coil portion being positioned outside of the air gap of the magnet assembly of the miniature transducer; and wherein the second voice coil portion, in a direction substantially perpendicular to the primary extension direction of the first voice coil portion, has a thickness being 2-5 times larger than a thickness of the first voice coil portion.

2. A miniature electro-acoustic transducer according to claim 1, wherein the first voice coil portion defines an outer voice coil region, and wherein the second voice coil portion extends into said outer voice coil region.

3. A miniature electro-acoustic transducer according to claim 1, wherein the first voice coil portion defines an inner voice coil region, and wherein the second voice coil portion extends into said inner voice coil region.

4. A miniature electro-acoustic transducer according to claim 1, wherein the first voice coil portion, in a plane substantially perpendicular to the direction of movement of the diaphragm, has a substantially rectangular shape.

5. A miniature electro-acoustic transducer according to claim 1, wherein the first voice coil portion, in a plane substantially perpendicular to the direction of movement of the diaphragm, has a substantially circular shape.

6. A miniature electro-acoustic transducer according to claim 5, wherein an inner voice coil region of the substantially circular shape has a diameter in the range 2-4 mm, such as a diameter of approximately 3 mm.

7. A miniature electro-acoustic transducer according to claim 1, wherein the first voice coil portion comprises a wound copper-clad aluminium wire.

8. A miniature electro-acoustic transducer according to claim 1, wherein the second voice coil portion comprises a wound copper-clad aluminium wire.

9. A miniature electro-acoustic transducer according to claim 1, wherein the first and second voice coil portions comprise a single copper-clad aluminium wire thereby forming an integrated voice coil.

10. A miniature electro-acoustic transducer according to claim 1, wherein the magnet assembly comprises an inner permanent magnet and an annular permanent magnet substantially concentrically arranged on a magnetically permeable yoke, the magnet assembly further comprising an inner pole piece and an annular pole piece arranged on the inner permanent magnet and the annular permanent magnet, respectively.

11. A miniature voice coil adapted to be attached to a diaphragm of a miniature electro-acoustic transducer, said voice coil comprising:

a first voice coil portion adapted to be positioned in an air gap of a magnet assembly of the miniature transducer, said first voice coil portion having its primary extension in a direction substantially parallel to a direction of movement of the diaphragm of the miniature transducer;

a second voice coil portion adapted to be attached to the diaphragm of the miniature transducer, and adapted to be positioned outside of the air gap of the magnet assembly of the miniature transducer; and wherein the second voice coil portion, in a direction perpendicular to the primary extension direction of the first voice coil portion, has a thickness being 2-5 times larger than a thickness of the first voice coil portion.

12. A miniature voice coil according to claim 11, wherein the first voice coil portion defines an outer voice coil region, and wherein the second voice coil portion extends into said outer voice coil region.

13. A miniature voice coil according to claim 11, wherein the first voice coil portion defines an inner voice coil region, and wherein the second voice coil portion extends into said inner voice coil region.

14. A miniature voice coil according to claim 11, wherein the first voice coil portion, in a plane substantially perpendicular to the direction of movement of the diaphragm, has a substantially rectangular shape.

15. A miniature voice coil according to claim 11, wherein the first voice coil portion, in a plane substantially perpendicular to the direction of movement of the diaphragm, has a substantially circular shape.

16. A miniature voice coil according to claim 15, wherein an inner voice coil region of the substantially circular shape has a diameter in the range 2-4 mm, such as a diameter of approximately 3 mm.

17. A miniature voice coil according to claim 11, wherein the first voice coil portion comprises a wound copper-clad aluminium wire.

18. A miniature voice coil according to claim 11, wherein the second voice coil portion comprises a wound copper-clad aluminium wire.

19. A miniature voice coil according to claim 11, wherein the first and second voice coil portions comprise a single copper-clad aluminium wire thereby forming an integrated voice coil.

20. A miniature voice coil according to claim 11, wherein a number windings of the first voice coil portion substantially equals a number of windings of the second voice coil portion.

* * * * *